US006070937A

United States Patent [19]

Ginat

[11] Patent Number: 6,070,937

[45] Date of Patent: Jun. 6, 2000

[54] CHAIR WITH USER RESPONSIVE RECLINABLE BACK-SUPPORT

[76] Inventor: Jonathan Ginat, 26 West 9th St., New York, N.Y. 10011

[21] Appl. No.: 09/145,598

[22] Filed: Sep. 2, 1998

[51] Int. Cl.[7] ..... A47C 3/00

[52] U.S. Cl. ..... 297/285; 297/286; 297/411.44

[58] Field of Search ..... 297/286, 296, 297/297, 301.1, 411.44, 411.4, 452.14, 452.15, 452.65, 285

[56] References Cited

U.S. PATENT DOCUMENTS 4,131,315 12/1978 Vogtherr ..... 297/286
4,157,203 6/1979 Ambasz .
4,557,521 12/1985 Lange ..... 297/286 X
4,889,385 12/1989 Chadwick et al. ..... 297/286 X
5,338,094 8/1994 Perry ..... 297/286 X
5,725,276 3/1998 Ginat .
5,810,438 9/1998 Newhouse ..... 297/286

*Primary Examiner*—Peter R. Brown
*Attorney, Agent, or Firm*—Natter & Natter

[57] ABSTRACT

A chair with user responsive reclinable back-support connected to a seat member by a set of elastically deformable bracket members. A pivot axis defined by an imaginary line connecting the respective center-of-curvature of the bracket members is positionable in substantial correspondence with the chair occupant's hip joint and is selectively displaceable under occupant loading for reclining the back-support.

7 Claims, 7 Drawing Sheets

CHAIR WITH USER RESPONSIVE RECLINABLE BACK-SUPPORT

BACKGROUND OF THE INVENTION

1. Field of the Invention

This invention relates generally to a chair having an adjustable back-support and especially to a back-support wherein movement to a reclined position is resiliently opposed.

In particular, the chair of this invention concerns a back-support that is user responsive and anatomically compliant.

2. Background Art

Current seating designs for office furniture, such as task chairs, have incorporated multiple positional adjustment features for providing user comfort. With regard to back-support, angular adjustability relative to the seat is commonly effected by a lever control tilt mechanism. The tilt mechanism frequently operates independently and/or in combination with a seat adjustment; other features provide for the tilt function to be locked-out, free-floating and/or set in a fixed angular orientation.

The tilt mechanism conventionally has a pivot point located below the seat and directly above the center of the chair base. The pivot point can also be located slightly ahead of the center so as to allow the chair occupant to recline at a slightly more relaxed angle than with the previously mentioned center-tilt. The pivot point can also be located near the front edge of the chair so as to allow the chair occupant to keep feet flat on the floor while the seat back is reclined. A further design, as shown in U.S. Pat. No. 4,157,203, places the pivot point or tilt axis above the seat at a location corresponding to about the middle of the back of the chair occupant.

A problem inherent in the aforementioned tilt mechanisms, is that the pivot point is not aligned with the hips of the chair occupant but rather is located approximately 6 to 8 inches below the hips of the occupant. Consequently, there is relative movement at the interface between the surfaces of the back-support and the occupant resulting in a frictional engagement of the occupants' clothing such that the chair occupant experiences an unpleasant "tugging" or "pull" upon the garment.

Although, the chair design as shown in U.S. Pat. No. 5,725,276 has a pivot point that is positioned above the seat and is intended to obviate this problem, the tilt mechanism is somewhat complex and it is relatively expensive to manufacture.

The back-support of the present invention includes a pivot point locus for tiltable movement that is more consistent with the chair occupant's anatomical positional change when reclining than with conventional tilt back chairs.

SUMMARY OF THE INVENTION

The nature of this invention involves a chair with a user-responsive reclinable back-support for ergonomic comfort.

Briefly, the chair of this invention includes a base, a seat member anchored on the base, a back-support member, with said back-support member being connected to the seat by a set of flexible arcuate brackets. Each of the brackets is attached at a first respective end to the seat member and at a second respective end to the back-support. The brackets define a bowed configuration extending above the seat member and are elastically deflectable under chair occupant loading about a center of curvature. A pivot axis is defined by an imaginary line connecting the corresponding pivot points of each of the respective bracket members. The back-support member is tiltably about the pivot axis and the pivot axis and back-support are concomitantly displaceable relative to the seat member.

In an alternate embodiment, the bracket members are each attached to a respective armrest. In another version, the bracket members are anchored to an anchor tube secured below the seat member.

A feature of this invention is that the displacement of the back-support to a reclining position is responsive to occupant loading and is not dependent upon lever operation. Additionally, the locus of the pivot axis above the seat member and in correspondence with the chair occupant's hip joint eliminates the garment "pull" phenomenon. A further advantage concerns the relative "floating" displacement of the pivot axis under load to more naturally follow occupant's body movement.

In view of the foregoing, it should be apparent that the present invention provides a reclinable back-support of the general character described herein which is not subject to the limitations of the prior art.

A preferred object of this invention is to provide a chair with user responsive reclinable back-support which offers improved comfort features.

Another preferred object of this invention is to provide a chair that is relatively simple in construction, reliable in use, attractive in appearance, and well adapted for mass production fabrication techniques.

With these ends in view, the invention finds embodiment in certain combinations of elements and arrangements of parts by which the aforementioned objects and certain other preferred objects are hereinafter attained all as more fully described with reference to the accompanying drawings and the scope of which is more particularly pointed out and indicated in the appended claims.

BRIEF DESCRIPTION OF THE DRAWINGS

In the accompanying drawings, in which are shown exemplary embodiments of the invention.

DETAILED DESCRIPTION OF THE INVENTION

With specific reference now to the figures in detail, it is stressed that the particulars shown are by way of example and for the purpose of illustrative discussion of the preferred embodiments of the present invention and are presented in the cause of providing what is believed to be the most useful and readily understood description of the principles and conceptual aspects of the invention. In this regard, no attempt has been made to show structural aspects of the invention in more detail than is necessary for a fundamental understanding of the invention, the description taken together with the drawings making apparent to those skilled in the art how the several forms of the invention may be embodied in practice.

Figure 1:
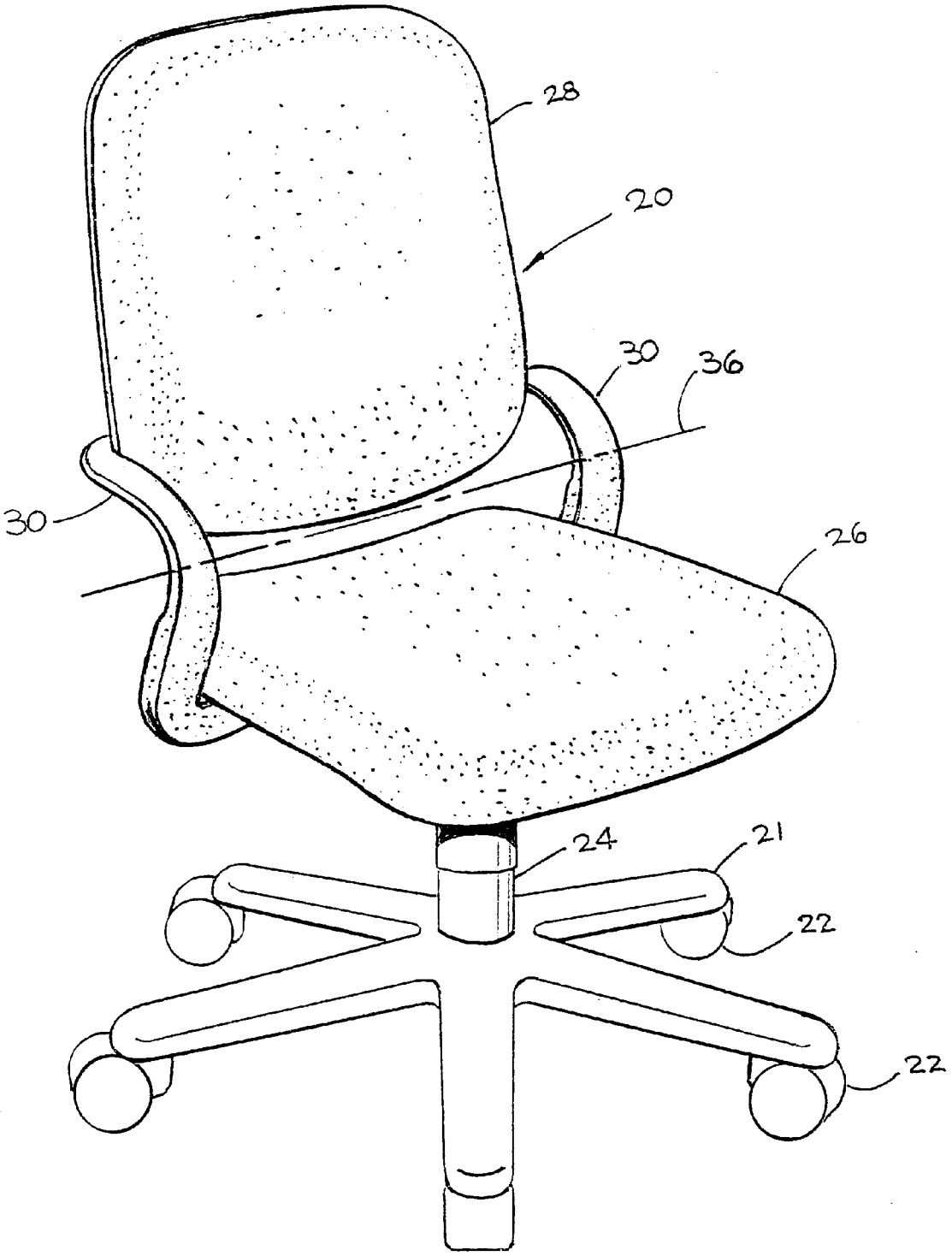
FIG. 1 is an elevational view of the chair constructed in accordance with the principles of this invention and illustrating a reclinable back-support, a seat member, a set of arcuate bracket members and a pivot axis located above the seat member.
Figure 5:
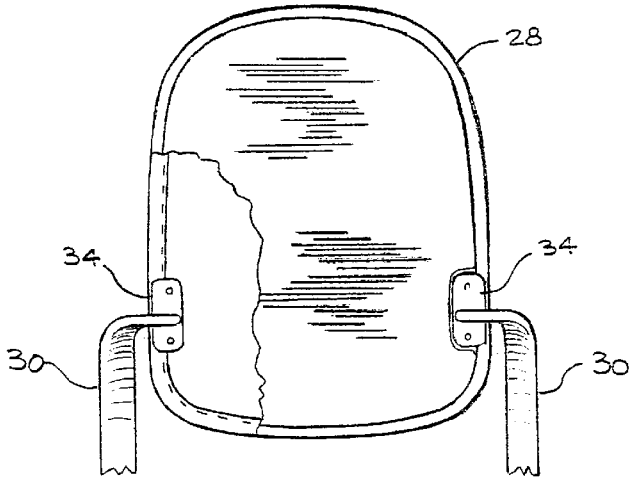
FIG. 5 is a rear elevational view of the back-support, in perspective, with a section broken-away and illustrating the attachment of the bracket member to the back-support.
Figure 6:
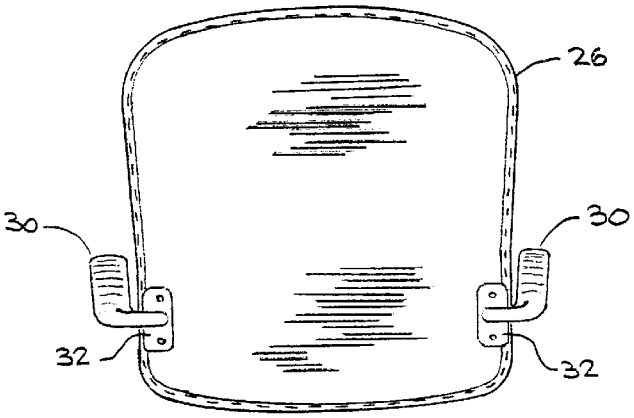
FIG. 6 is a plan view of the underside of the seat member in perspective, showing the attachment of the bracket member to the seat member.

With reference now to FIG. 1 there is shown a chair 20 in accordance with this invention. The chair 20 is typically illustrated as having a five star base 21 including a plurality of hooded casters 22, and a pedestal 24 supporting a seat member 26. A back-support 28 is connected to the seat member 26 by a set of bracket members 30. The bracket members 30, include a mounting plate 32 for bolt attachment to the bottom of the seat member 26 as typically shown in FIG. 6. The bracket members 30 are similarly attached to the underside of the back-support 28 by a mounting plate 34 as illustrated in FIG. 5.

Figure 3:
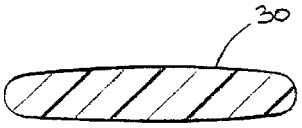
FIG. 3 is a sectional view taken along line 3—3 of FIG. 2 showing a cross-sectional configuration of the bracket member.
Figure 4:
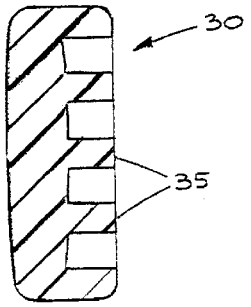
FIG. 4 is a sectional view taken along line 4—4 of FIG. 2 showing a cross-sectional configuration of the bracket member and the stiffening ribs.

It should be noted that the bracket member 30 is designed as a flexure member and is preferably manufactured of a homogeneous material, such as an "engineered plastic", so as to bend under stress. Furthermore, a rigidity modifier, such as a plurality of stiffening ribs 35 is incorporated in the bracket member 30, at approximately the lower one-third of its length immediately adjacent the seat member 26, and may be formed integrally therewith. It should also be observed that the bracket member 30 is gradually tapered in a direction toward the back-support member 28 and that the cross-sectional area is reduced as indicated by a comparison of cross-section 3—3 (FIG. 3) with the cross-section 44 (FIG. 4) such that the flexural rigidity of the bracket member 30 is not constant. The combination of the ribs 35 and the tapered configuration of the bracket member 30 are effective for positioning the center-of-curvature above the seat member 26 as will be further discussed hereinafter.

Figure 2:
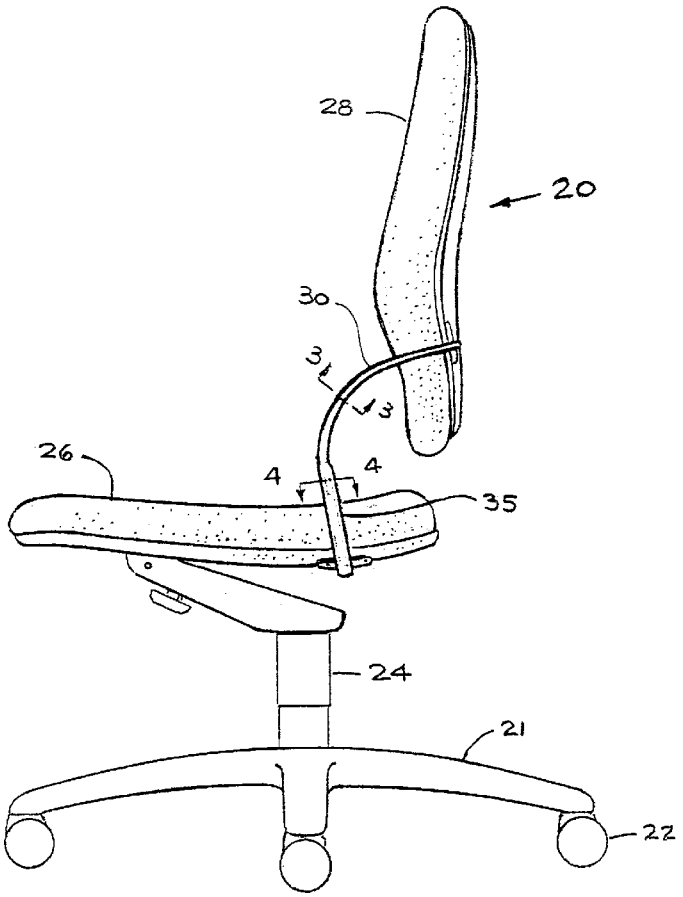
FIG. 2 is a side elevational view of the chair of FIG. 1 showing the bowed and tapered configuration of the bracket member and also showing a stiffening rib.
Figure 2A:
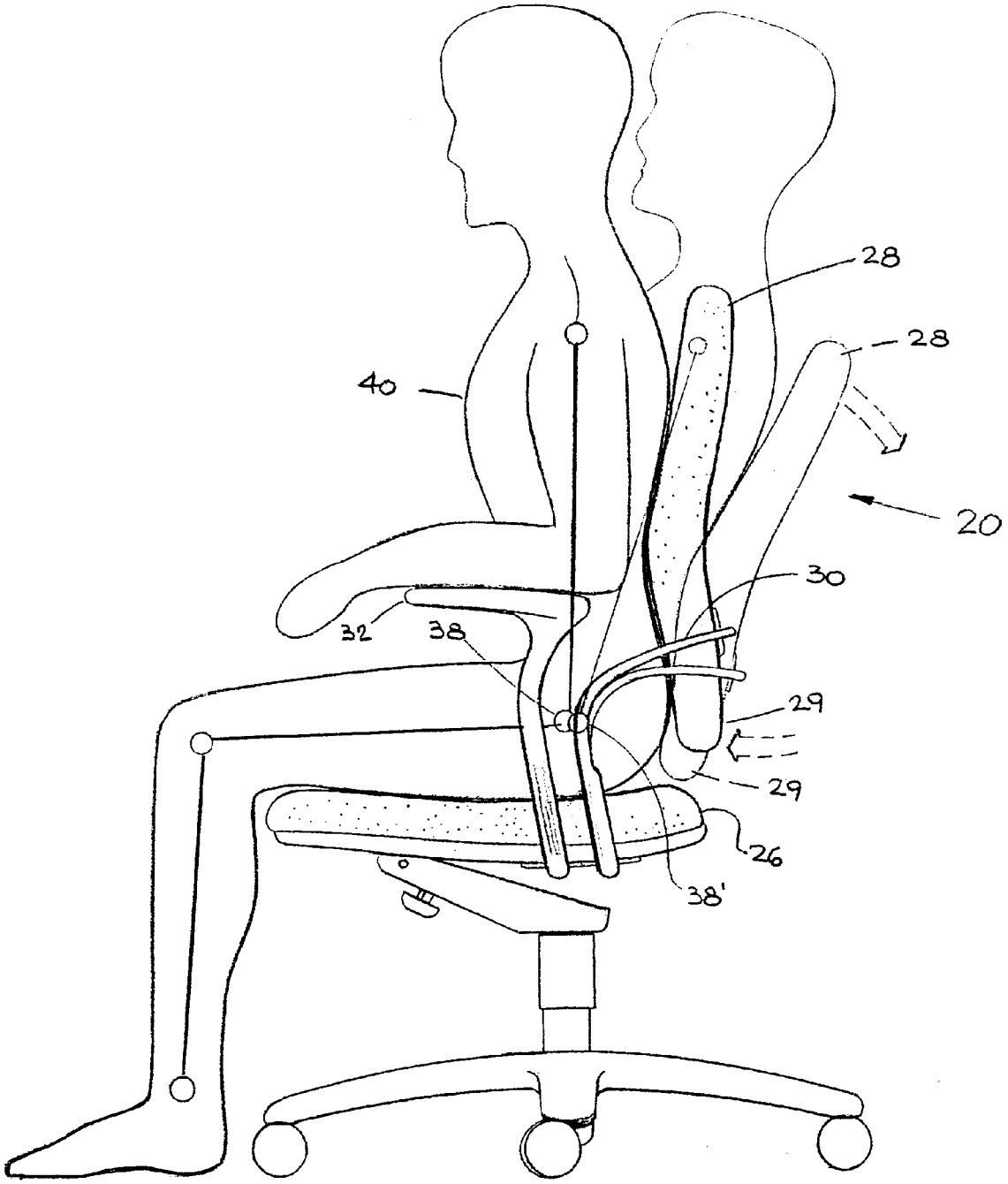
FIG. 2A is a side elevational view of an alternate embodiment of the chair shown in FIG. 1 as modified to include an armrest and illustrating, in phantom lines, the deflection of the bracket member under load.

The bracket member 30 will deflect in response to user loading and will return to a static equilibrium or neutral position upon removal of the load. It will require a greater force to initiate the reclinable movement and as the back-support 28 is progressively displaced, the magnitude of the force required will be reduced. The displacement of the back-support 28, under load is typically shown in FIG. 2A. The chair 20 shown in FIG. 2A is substantially identical to the chair 20 in FIG. 1 with the exception that an arm support 32 has been added. When under occupant loading, the back-support 28 is displaced about an imaginary pivot axis 36 that is substantially registered with the hip joint 38 of the chair occupant 40 (see FIG. 2A). The pivot axis 36 passes through the center-of-curvature or inflection point i.e. where the bending moment is zero-valued.

As the chair occupant 40 assumes a reclining position, the bracket members 30 are resiliently deflected, as shown in FIG. 2A. The chair occupant's hip joint 38 is displaced as indicated by reference numeral 38' and the pivot axis 36 is similarly repositioned rearwardly. It should be observed that movement of the back-support 28, has both an angular and a linear component. This compound movement conforms to the anatomical reorientation of the chair occupant 40. It should also be apparent that there is substantially no relative surface movement between the back-support 28 and the chair occupant 40 during displacement to the reclined position and therefore garment "pull" is virtually eliminated. Note also that a tail section 29 of the back-support 28, extending below the mounting plate 34, tilts forwardly for supporting the lower back of the chair occupant 40. The back-support 28 will remain in the reclined position while under load and will assume a neutral position upon removal of said loading.

Figure 7:
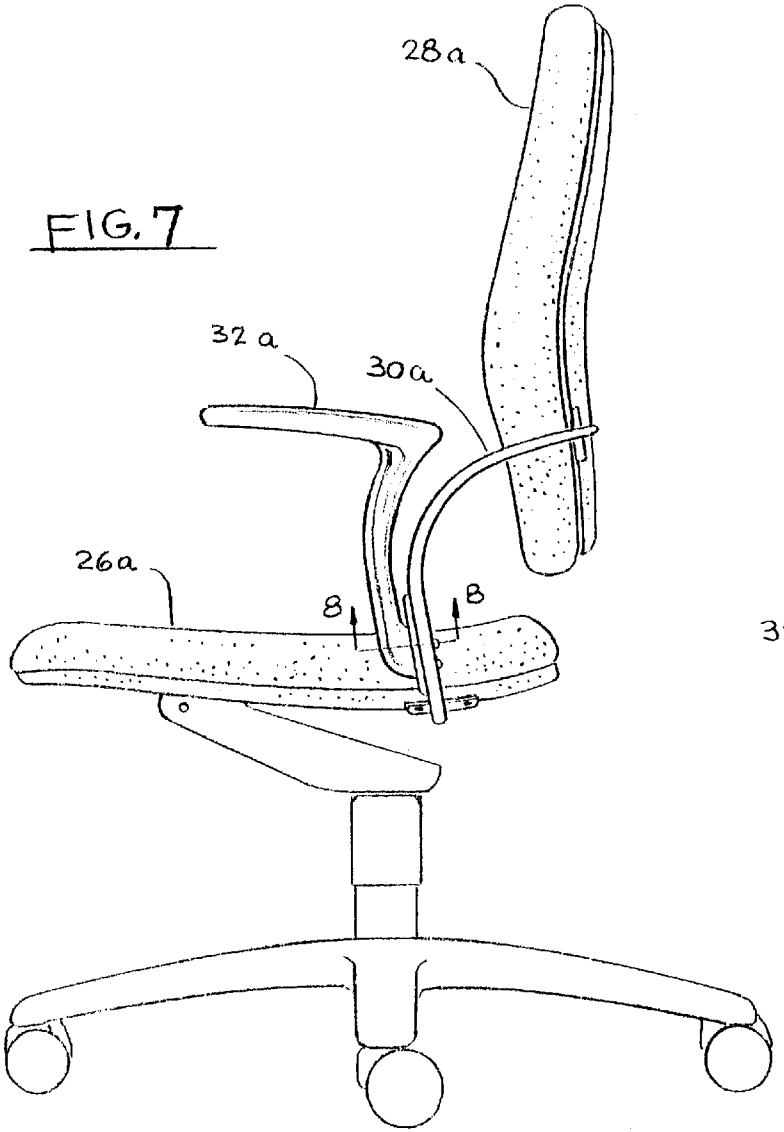
FIG. 7 is an elevational view in perspective, showing an alternate embodiment wherein an armrest is anchored to the bracket member.
Figure 8:
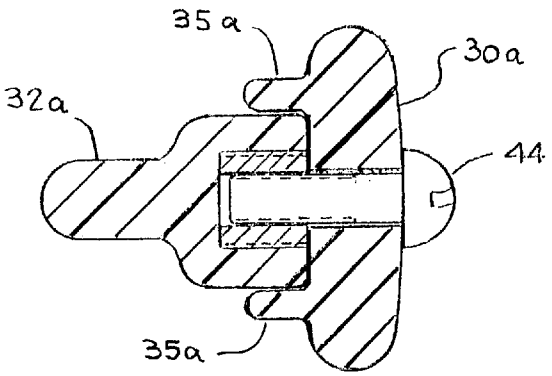
FIG. 8 is a sectional view, to an enlarged scale, taken substantially along line 8—8 showing in detail, a bolt connection between the armrest and the bracket member.

Referring now to FIG. 7, there is shown an alternate embodiment wherein like numerals have been used to represent corresponding components however in this embodiment the suffix (*a*) has been added to the reference numerals. An armrest 32*a* has been anchored directly to a bracket member 30*a*. The bracket member 30*a* has further been modified to include stiffening ribs 35*a*. The armrest 32*a* is secured to the bracket member 30*a* by a threaded bolt 44 as shown in FIG. 8. The ribs 35*a* function in a manner similar to the ribs 35 of the previous embodiment.

Figure 9:
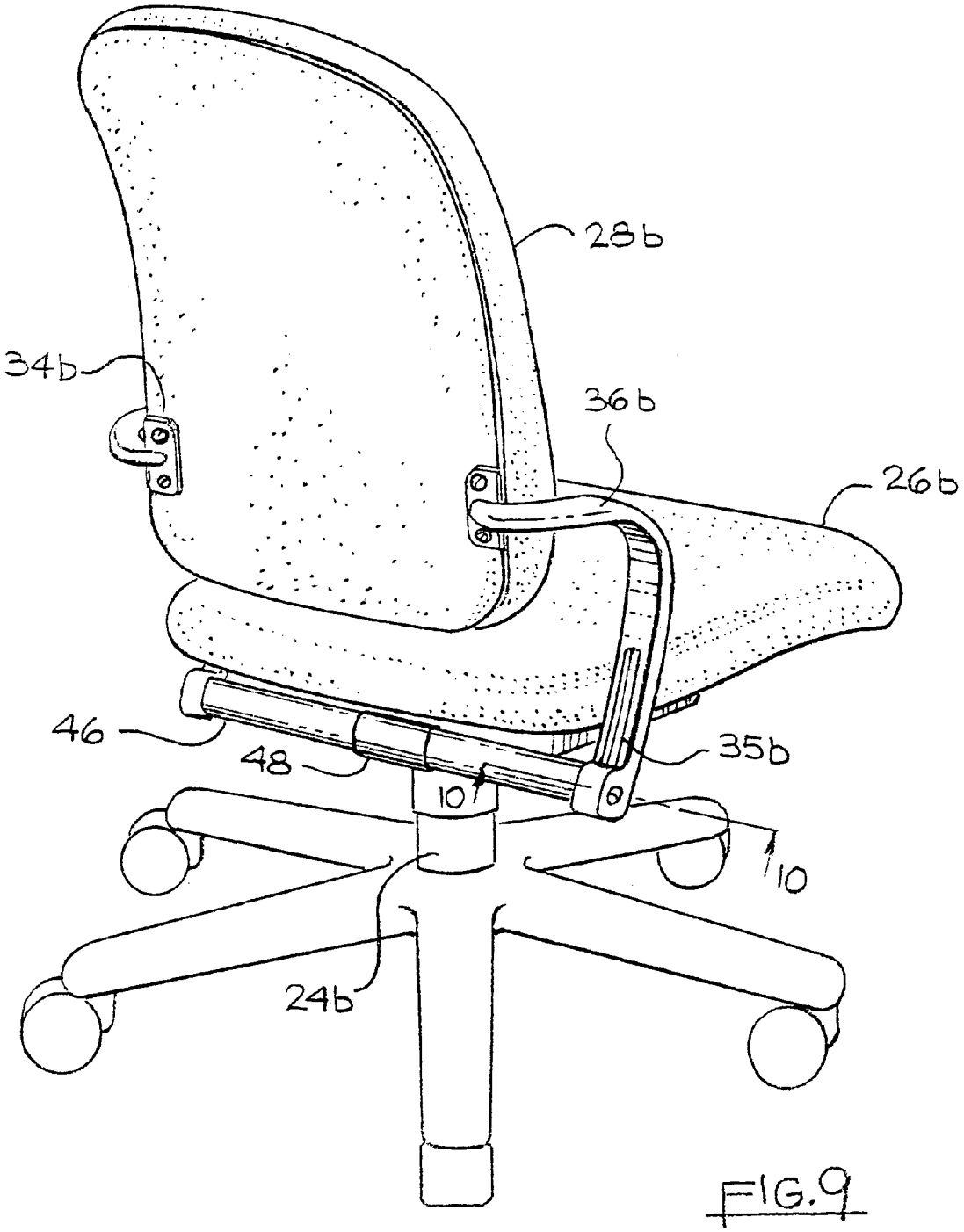
FIG. 9 is a perspective view in perspective, of an alternate embodiment showing the bracket member secured to an anchor tube.
Figure 11:
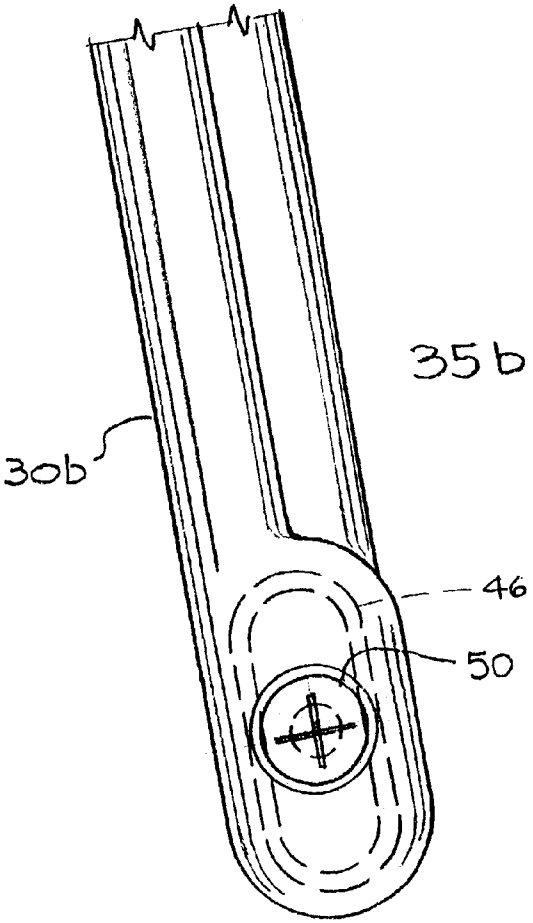
FIG. 11 is an auxiliary side elevational view, taken to an enlarged scale, showing the connection between the bracket member and the anchor tube.
Figure 10:
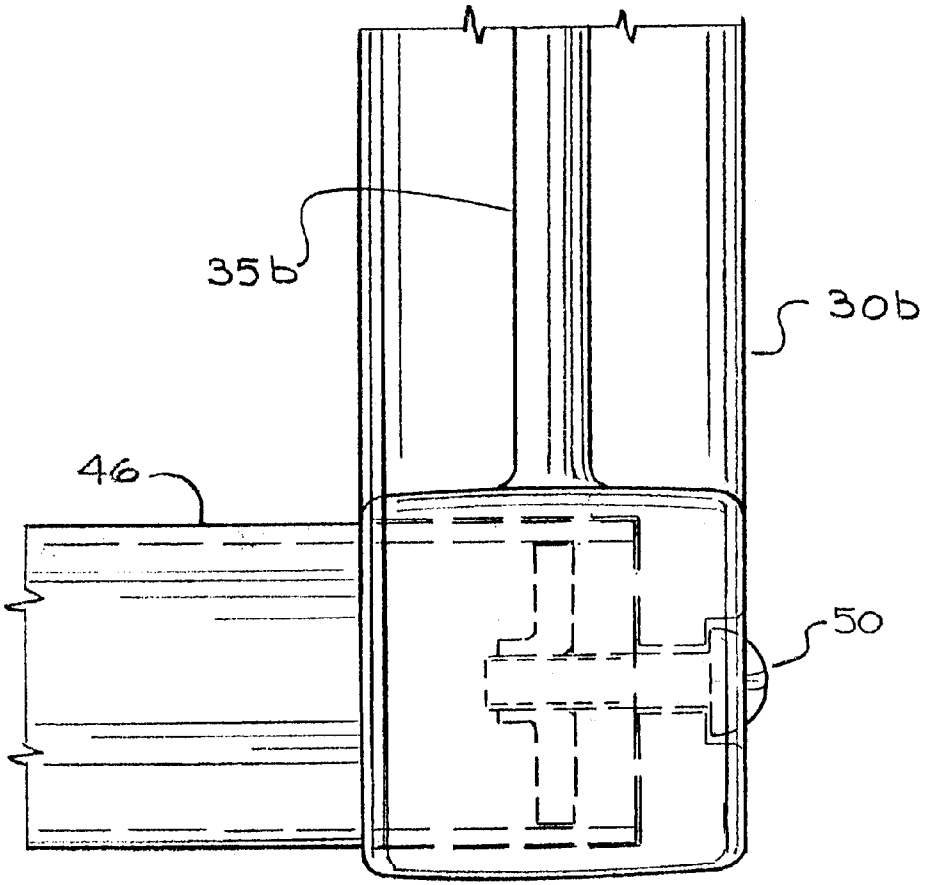
FIG. 10 is an auxiliary view partially in section, to an enlarged scale, taken substantially along line 10—10 of FIG. 9 and showing the interconnection between the bracket member and the anchor tube.

Another version is shown in FIGS. 9–11 wherein similar numerals have been used to designate corresponding parts with the addition of the suffix (*b*). In this variant, a bracket member 30*b* is anchored to an anchor tube 46. The anchor tube 46 is preferably made from heavy-gauge tubular steel, has an oval cross-section (as shown in FIG. 11) and is secured by a sleeve 48 that is mounted to a chair pedestal 24*b*, the underside of the seat member 26*b*, or to one of the several conventional chair tilt mechanisms. The respective ends of the bracket member 30*b* define a recess for accommodating an end of the tube 46 as shown in FIG. 10. A threaded bolt 50, or similar fastener is employed for securing the bracket member 30*b* to the anchor tube 46.

It should further be noted that the bracket member 30*b* is provided with a stiffening rib 35*b* for providing the flexural rigidity to achieve the desired deflection characteristics.

It should be further understood that the reclinable back-support of this invention can be incorporated and used in combination with chairs having knee-tilt, posture-tilt, sychro-tilt and other adjustment functions.

It will be evident to those skilled in the art that the invention is not limited to the details of the foregoing illustrative embodiments and that the present invention may be embodied in other specific forms without departing from the spirit or essential attributes thereof. The present embodiments submitted are in all respects illustrative and not restrictive, the scope of the invention being indicated by the appended claims rather than by the foregoing description, and all changes which come within the meaning and range of equivalency of the claims are therefore intended to be embraced therein.

Having thus described the invention, there is claimed as new and desired to be secured by Letters Patent:

1. A chair having a user responsive reclinable back-support comprising a pedestal, a seat member attached to the pedestal, a back-support, said back-support being connected to the seat member by a set of flexible arcuate bracket members extending above the seat member, said bracket members being gradually tapered for varying the flexural rigidity with a maximal cross-sectional area being adjacent to the seat member and a minimal cross-sectional area being adjacent to the back-support, said bracket members further being elastically deformable about a center-of-curvature during chair occupant loading to define a compound movement of the back-support from a neutral position to a reclined position, said back-support being returnable to a neutral position upon removal of said loading.

2. A chair as claimed in claim 1 wherein the arcuate bracket members define a pivot axis in correspondence with the center-of-curvature, said pivot axis lying above the seat member and forwardly of the back-support for substantially eliminating relative surface movement between the back-support and the chair occupant during displacement to the reclined position.

3. A chair as claimed in claim 2 wherein the pivot axis of the bracket member is positionally adapted for substantial correspondence with the location of the hip joint of a chair occupant and is concurrently displaceable rearwardly under occupant loading.

4. A chair as claimed in claim 2 wherein the pivot axis is displaceable during elastic deformation of the bracket member.

5. A chair as claimed in claim 2 wherein the bracket member is attached to the seat member at one end thereof and is attached to the back-support at the other end thereof.

6. A chair as claimed in claim 1 wherein the bracket member is formed with a rigidity modifier comprising stiffening ribs extending along approximately the lower one-third of the length of the bracket member adjacent to the seat, said modifier being adapted to change the flexural rigidity of the bracket member for positioning the center-of-curvature above the seat member.

7. A chair as claimed in claim 1 wherein the back-support includes a tail section, said tail section being adapted to provide support for a lower back area of a chair occupant when the back-support is in the reclined position.

* * * * *